US005855082A

United States Patent [19]

Bayler

[11] Patent Number: 5,855,082

[45] Date of Patent: Jan. 5, 1999

[54] SWITCH GUARD FOR AN IRON

[75] Inventor: Howard O. Bayler, Palmdale, Calif.

[73] Assignee: Frank L. Zugelter, North Hollywood, Calif.

[21] Appl. No.: 840,537

[22] Filed: Apr. 22, 1997

[51] Int. Cl.[6] ..... D06F 75/36; H01H 9/02

[52] U.S. Cl. ..... 38/94; 38/77.7; 200/43.18

[58] Field of Search ..... 38/74, 75, 77.1, 38/77.5, 77.6, 77.7, 88, 89, 94, 95; 219/240, 250, 256; 200/43.01, 43.16–43.22, 333, 334

[56] References Cited

U.S. PATENT DOCUMENTS

| | | | |
|---|---|---|---|
| 1,095,925 | 5/1914 | Pogue | 38/75 X |
| 2,106,936 | 2/1938 | Smith | 219/256 |
| 2,133,600 | 10/1938 | Vea | 219/256 |
| 3,530,604 | 9/1970 | Hardaker | 38/75 |
| 4,623,765 | 11/1986 | Leyden | 200/43.22 |
| 4,882,456 | 11/1989 | Hovanic et al. | 200/43.19 X |
| 5,486,660 | 1/1996 | Fasano | 200/43.16 |

*Primary Examiner*—Ismael Izaguirre
*Attorney, Agent, or Firm*—Frank L. Zugelter

[57] ABSTRACT

A guard (22) that prevents damage or breakage to a device, for example, an electrical switch mechanism's housing (12) and its components associated with an iron (10). The guard (22) embraces the housing (12), being securely mounted with the housing (12) to a bracket (13) in turn securely mounted to the iron (10), proximate to the front end of its handle (14). It comprises a pair of panels (23, 24) joined together by a frontal panel (28), its rear being open. Its dimensions exceed the dimensions of the device's housing (12) to assure that impact from a force applied to iron (10) in the area of the location of the housing (12) absorbs whatever impact the force may produce, rather than the housing (12) itself being directly impacted by such force and thereby be damaged or broken along with its components. A pair of spaced apertures (41, 42) is included in each of the panels (23, 24), with one in each pair being put into alignment with a corresponding one in the other panel, in the installation of guard (22) to the housing (38) and to the bracket (13). A device (17) extends through the apertures (41, 42) and holes in bracket (13) to affix guard (22) and housing (12) to the bracket (13) and iron (10).

15 Claims, 2 Drawing Sheets

2/2

SWITCH GUARD FOR AN IRON

TECHNICAL FIELD

This invention relates to a guard that protects a device, an object, or an article from damage or breakage, and is particularly related to a guard to protect an electrical switch and other parts on a steam iron from damage or breakage.

PROBLEMS IN THE ART

On steam irons, there is an electrical switch which activates a solenoid to open a needle valve whereby passage of steam from ports in the base of the iron onto apparel or other materials occurs. In the manipulation of the iron, deliberately or by accident, by operator or otherwise, the switch's housing and parts, in instances have been subject to impact by a force, such as, for example, by an ironing board, floor, or other obstruction. Breakage of the housing or damage to the mechanism's housing or its components within the housing occurs, thereby postponing use of the iron for a period of time as well as the need for its repair. This invention eliminates the inconvenience arising out of breakage and/or damage while also providing for savings of time and money.

SUMMARY OF THE INVENTION

The invention is incorporated within an article that embraces the switch's mechanism's housing so that an impact made upon the iron or other article guards the housing and its mechanism from damage or breakage. The impact occurs on the article, i.e., a guard and not on the housing or its mechanism. The guard comprises a pair of panels having apertures therein and joined together by a frontal panel. Bolts mount the pair of panels to and through the switch's housing to a bracket that supports the housing and secures it to the iron. The frontal panel provides for an integrally formed article, and cut-out recesses are provided in the panels to provide ready access by an operator's thumb to the steam-actuating button of the switch's mechanism, whereby steam discharges from the iron's ports. Should the iron be propelled in a direction to meet an obstruction, either by a manipulation of its operator's hand grasping the handle of the iron or by an accidental movement, and by which impact is in the area of the location of the housing, the guard protects the housing, the mechanism, the switch's button and its components from breakage and/or damage by reason of the guard's dimensions exceeding the housing's fullest or outermost dimensions.

An object of this invention is to provide a novel guard.

Another object of this invention is to preclude damage or breakage to an element or article to which the guard is secured, thereby obviating the inconvenience of the necessity of repairing the element or article or installing a new and perhaps more costly substitute.

A further object of this invention is to maintain an iron with an electrical switch mechanism thereon in an operative condition for a longer or indefinite period of time during which the mechanism and/or its housing may be subject to many blows or impacts that otherwise would break or damage it were the guard of the invention not available and installed on the switch's housing.

These and other objects and advantages of the invention will become more apparent by a full and complete reading of the following description, its appended claims and the accompanying drawing comprising two (2) sheets of six (6) FIGURES.

PREFERRED MODE OF CARRYING OUT THE INVENTION

Figure 2:
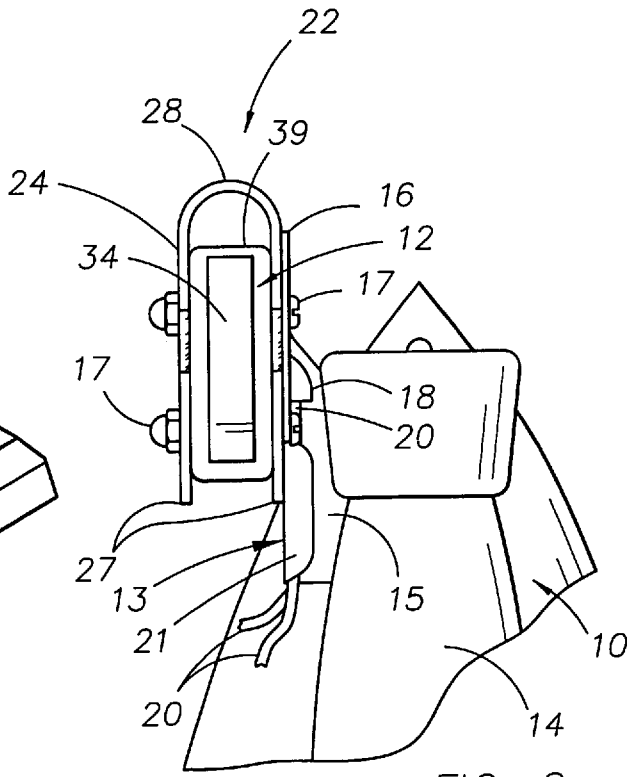
FIG. 2 is a fragmentary plan view of FIG. 1, over such housing and the guard mounted thereto.
Figure 1:
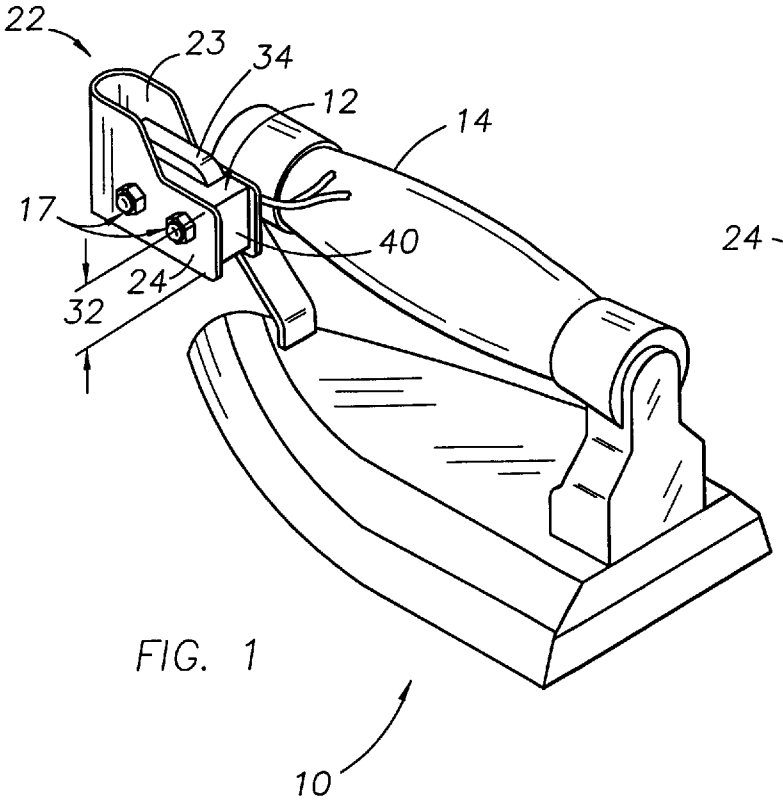
FIG. 1 is a perspective view of an iron having an electrical switch mechanism's housing mounted thereto and to which the guard of this invention is shown applied.
Figure 3:
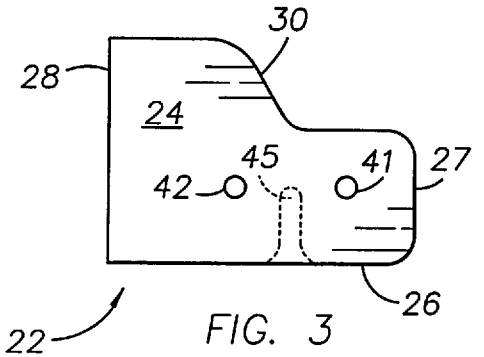
FIG. 3 is a side elevational view of the guard of this invention.

Referring now to the reference characters shown in the drawing and which correspond to like numerals hereinafter, FIG. 1 illustrates an iron 10 on which an electrical switch mechanism's housing 12 is mounted thereto by means of a bracket 13, FIG. 2, securely mounted to the iron 10 adjacent and proximate to the front end of the iron's handle 14. The bracket 13 is securely mounted (not visible) to the iron 10 in a customary manner by its horizontally-oriented segment 15. A vertically-oriented segment 16, FIG. 2, of bracket 13 is integrally formed to segment 15 and to which the housing 12 is particularly fastened by means 17 such as screws, bolts, nuts and/or the like. The vertically-oriented segment 16 includes a punched-out portion 18 forming an open pocket through which electrical wiring 20 from the switch's mechanism passes, extending therefrom to their electrical connections elsewhere and by which a needle valve (not shown) is actuated to produce a passage of steam from ports (not shown) in the base of the iron 10. A curled tube 21 formed on segment 16 feeds the wiring 20 in a proper manner to such electrical connections elsewhere.

Figure 4:
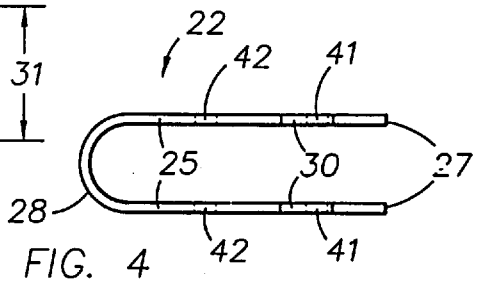
FIG. 4 is a top plan view of the guard of this invention.
Figure 5:
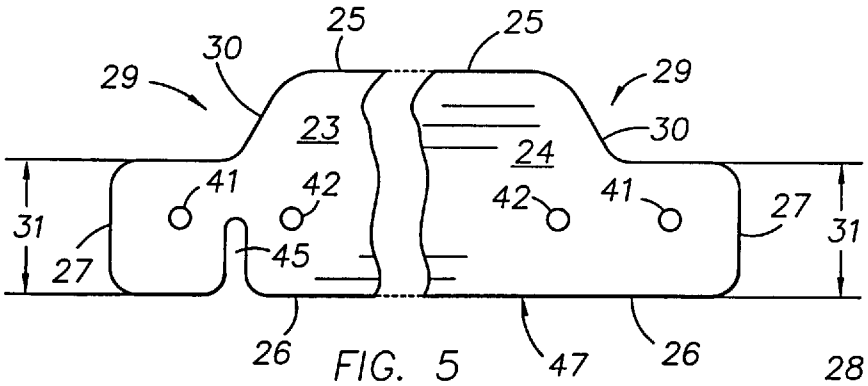
FIG. 5 is a view of a flat fabricated member that forms the pattern for the guard.

The guard 22 includes a suitable thickness for its purpose and comprises a pair of spaced panels 23, 24, each having a top edge 25, FIG. 5, a bottom edge 26, and a rear edge 27, along with a frontal panel 28, FIG. 4, integrally joining together the spaced panels 23, 24 which are generally in alignment or parallel to the walls of the switch's housing 12 or other article to which it is to be applied. A recessed or cut-out portion 29 is included in each panel 23, 24, (at least in panel 23), directed inwardly of its panel from its to edge 25, and extending to the rear edge 27 of its panel. An edge 30, illustrated in an inclined manner extending from the top edge 25 to the rear edge 27, generates the body formation for the cut-out portion or recess 29, and terminates at a point along the length of the rear edge 27 by which an adequate length 31 of the rear edge 27 remains in order to be of a linear dimension that exceeds the depth 32, FIG. 1, of dimension of the switch's housing 12 or other device to be protected. The extant of the cut-out portions 29 in the panels 23, 24 is of dimensions that provide directional and unobstructional access by an operator's thumb (not shown) to the switch's button 34 depression of which actuates a solenoid (not shown) for opening the noted needle valve. The width of each panel 23, 24 is of a dimension that exceeds the fullest height for the switch's housing 12 (in this embodiment of the invention as applied to the switch, it is above the top most point on button 34) and the length of each panel 23, 24 is of a dimension that exceeds the length of the switch's housing 12 (such length being clearly visible in FIG. 2), in the installation of the guard 22 thereto or to another device or article to be protected. In the instant illustrated embodiment, with the possible exception of at least in the one cut-out portion 29 in panel 23, such width extends above the level of the uppermost point of button 34, and below the level of the bottom of the housing 12, while the lengths of panels 23, 24 extend beyond the front and back walls 39, 40, FIGS. 1, 2, of the housing 38.

Each panel 23, 24 includes an aperture 41, 42, FIG. 5, the aperture 41 in each of such panels in horizontal alignment with the aperture 41 in the other of such panels, and the aperture 42 in each of such panels in horizontal alignment with the aperture 42 in the other of such panels. However, the spacing between an aperture 41 with an aperture 42 in its own or same panel is correlated to the spacing of bores (not visible) contained in and along the length of the housing 12 or other device to be protected. It is to be noted that these bores by which the device's housing 12 is secured to the vertically-oriented segment 16 of the bracket 13 by the means 17, are adaptable for affixing the guard 22 to the housing 12 and further, in turn, to the bracket's segment 16. As an example, a bolt and its nut, which form means 17, is to be inserted through each of the pair of apertures 41 and through each of the pair of apertures 42 after mounting of the guard 22 to the housing 12, as these apertures will be in alignment with a corresponding one of the housing's bores extending across the width of the device to which the guard is being mounted. Further, spaced holes (not visible) in the vertically-oriented segment 16 correlate to the spacing provided in the housing 12 for means 17 and to the spacing of the noted apertures in the panels of the guard 22.

A slot 45, FIG. 5, extends inwardly of the bottom edge 26 of the one panel 23, for accepting the wiring 20 from the housing 12 which projects from the open pocket formed by the punched-out portion 18 in the panel 22, in order to continue its direction into the curled tube 21 mounted on the vertically-oriented segment 16 of the bracket 13.

In operation, with guard 22 in secured position upon the switch's housing 12, should the movement of the iron 10 with its mounted guard 22 place a point of impact proximate to or upon the position of the housing 12, the guard 22 prevents direct physical contact of the housing 12 with the point of impact, thereby removing the danger of damage or breakage to the housing or any component or part of the switch.

In the installation of guard 22 to housing 12, with the panels 23, 24 disposed in a generally parallel fashion to one another, after the rounding of frontal panel 28 having been formed, they are placed into a disposition of embracing the housing 12, the frontal panel 28 surrounding the front of the housing 12, the panels abutting their corresponding sidewalls of the housing 12, which is not yet mounted to the bracket 13. The rear edges 27 of the panels 23, 24 are disposed rearwardly of the backwall 40 of housing 12, and the disposition of the top and bottom edges 25, 26 of the panels 23, 24 exceed the planes of the housing's top most and bottom most points, respectively. The slot 45 in the one panel 23 that is to abut the vertically-oriented segment 16 is to pass around the wiring 20 at a point before the wiring 20 enters the punched-out portion 18 of the segment 16, as this sub-assembly step proceeds. This sub-assembly of guard-to-housing is placed up against the vertically-oriented segment 16 of the bracket 13 in a manner that provides for insertion of a suitable means 17 through holes suitably provided in such segment 16 and then through the bores (not shown) extending across the width of the housing 12. Each means 17 includes a head that abuts against segment 16 and a threaded end that projects past the outer disposed panel 24 for threading to its corresponding nut, thereby securing both housing 12 and its guard 22 to the bracket 13. Thus, the guard is affixed to the housing 12, which remains virtually in its same position on the iron 10 that it would have been without the addition of the guard to it. And it may be noted that this assembly may take place prior to securely fastening the horizontally-oriented segment 15 to iron 10 itself.

Figure 6:
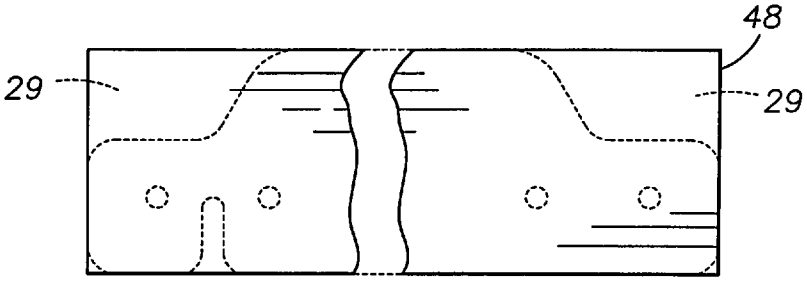
FIG. 6 is a view of a flat unfabricated sheet of material from which the fabricated member of FIG. 5 is formed.

The fabrication of guard 22 is prepared from a pattern 47, FIG. 5, stamped out of a flat, strong, yet pliable, sheet 48 of material, FIG. 6, preferably Teflon, mounted in a steel rule die. The pattern 47 is cut or punched out in known and customary manner from the sheet 48, to form the body formations of the guard's apertures, its edges forming the bottom, rear, slotted, and recessed configurations, and as illustrated in the drawing. Preferably, these elements are fabricated from one sheet 48, in an integrated manner, rather than from a number of separate sheets, although in the carrying out of the invention such fabrication may be performed in that manner as well.

When it is necessary to install another guard to replace the mounted one, it is a simple task to remove the mounted one and install another guard in its mounted position on the housing 12 and bracket 13.

Various changes and modification may be made without varying from the spirit and scope of the invention and as set down in the appended claims, and without unnecessarily limiting the scope of protection afforded by them. As indicated above in regard to the illustrated embodiment of the guard 12 to an electrical switch, the uppermost dimension or limit of button 34 also is considered the outermost limit of the housing's dimension in that direction. It should be understood that a housing may have an uppermost dimension in another direction as well, and to which housing the invention may be applicable. Only the panel 23 abutting the vertically-oriented segment 16 of the bracket 13 need have a cut-out portion 29, for directional movement of an operator's thumb to the button 34 on the housing 12. The direction of the edge 30 is not limited to the illustrated inclination shown in the drawing, but may take other geometrical inclinations, as for an example, a right-angled configuration. The slot 45 need not be included in its panel 23 should another way be considered and undertaken for extending the wiring 20 from the housing 12. The guard may be affixed to its article by apertures not correlated only to bores in the article. The pliability of the material of the guard, such as found in Teflon, should provide a long-lasting, indefinite period of life for the guard in its mounted position on the bracket 13, as in actual practice, impacts to iron 10 and striking obstructions thereby do occur, although other suitable materials also may be utilized.

I claim:

1. A guard for a device having a housing to be protected from impact of force that would damage or break it and/or its components, and comprising a pair of panels in spaced alignment with one another for mounting to the housing and having edges, said edges being disposed at dimensions of said panels that exceed the extents of-the-length and of-the-depth dimensions for said housing, said guard adapted to be mounted to said housing, and means for mounting said guard to the housing, said mounting means comprising at least one aperture in each of said panels, the one aperture in alignment with the other aperture for insertion of a securing means between the one aperture and the other aperture.

2. The guard of claim 1 including a frontal panel joining together said pair of panels, said frontal panel including edges disposed at its dimensions exceeding the dimension of depth of the housing to which said frontal panel is to be mounted.

3. The guard of claim 1 or claim 2 including securing means.

4. The guard of claim 3 wherein said securing means comprises a threaded bolt and its nut, said bolt projecting through said mounting means.

5. The guard of claim 1 or claim 2 wherein at least one of said pair of panels includes a top edge and a rear edge and a recessed portion in said one of said pair of panels extending between said top and rear edges for access to said housing.

6. The guard of claim 5 including securing means.

7. The guard of claim 6 wherein said securing means comprises a threaded bolt and nut, said bolt projecting through said mounting means.

8. The guard of claim 5 including securing means operatively connected to the aligned panels by insertion through the one aperture and through the other aperture.

9. The guard of claim 8 wherein said securing means comprises a threaded bolt and nut.

10. The guard of claim 1 or claim 2 wherein said one of said pair of panels includes a slot through which electrical wiring passes from the housing and past said one of said pair of panels upon adapting the device to the housing.

11. The guard of claim 5 wherein said one of said pair of panels includes a slot through which electrical wiring passes from the housing and past said one of said pair of panels upon adapting the device to the housing.

12. An assembly of a housing of an actuating device to be protected and a guard mounted to the housing to so protect said device, said housing having a width to each side of which a wall of said housing is disposed and an actuator for said device being mounted on said housing, said guard comprising a pair of panels and means in said panels to mount it to said housing, each of said pair of panels including a top edge, a bottom edge, a rear edge, and a recessed portion in at least one of said pair of panels extending between its top edge and its rear edge for access to the actuator mounted on said housing, each of said pair of panels having dimensions that exceed the extent of-the-length and of-the-depth dimensions of said housing in their assembly thereto, thereby protecting the housing and its actuator from an impact while providing such access to the actuator, and means for securing said guard to said housing, and a bracket, said assembly operatively connected to said bracket adapted for attachment to a steam iron.

13. The assembly of claim 12 wherein said one of said panels includes a slot and the bracket includes a punched-out portion for passage of electrical wiring extending from the actuator and through said slot to and through said punched-out portion.

14. The combination of the assembly of claim 12 and the bracket of claim 1 with a steam iron, said bracket being securely fixed to the steam iron.

15. A pattern for a guard that protects a housing and its components from impact, comprising a flat member having a top edge, a bottom edge, a pair of rear edges, a central portion between said rear edges, and an inclined edge connecting the top edge to each of the rear edges, and at least one pair of apertures, the spacing between said pair of apertures being such that as the member is rounded in its central portion as to cause alignment of its rear edges with one another the apertures are in alignment with each other, and a slot formed inwardly from said bottom edge, said slot disposed along the length of said bottom edge so as to provide for wiring from an electrical actuator mounted on said housing when alignment of said rear edges is effected for mounting the guard formed from said pattern by the rounding of its central portion.

* * * * *